US007023308B2

(12) United States Patent
Woods

(10) Patent No.: US 7,023,308 B2
(45) Date of Patent: Apr. 4, 2006

(54) MAGNETIC SWITCH ASSEMBLY

(75) Inventor: Randall Woods, Gilbert, AZ (US)

(73) Assignee: Magnasphere Corporation, Brookfield, WI (US)

( * ) Notice: Subject to any disclaimer, the term of this patent is extended or adjusted under 35 U.S.C. 154(b) by 162 days.

(21) Appl. No.: 10/717,762

(22) Filed: Nov. 20, 2003

(65) Prior Publication Data

US 2005/0110600 A1 May 26, 2005

(51) Int. Cl.
*H01H 9/00* (2006.01)

(52) U.S. Cl. ..... 335/205; 340/547; 335/207

(58) Field of Classification Search ..... 335/205–207; 340/547

See application file for complete search history.

(56) References Cited

U.S. PATENT DOCUMENTS 5,332,992 A 7/1994 Woods
5,530,428 A 6/1996 Woods
5,610,338 A * 3/1997 Kato et al. ..... 340/690
5,673,021 A 9/1997 Woods
5,880,659 A 3/1999 Woods
5,965,855 A * 10/1999 Tanazawa et al. ..... 335/205
5,977,873 A 11/1999 Woods
6,087,936 A 7/2000 Woods
6,506,987 B1 1/2003 Woods
6,603,378 B1 8/2003 Collins
6,803,845 B1 * 10/2004 Woods ..... 335/207
2003/0015408 A1 1/2003 Woods
2003/0016106 A1 1/2003 Woods

* cited by examiner

*Primary Examiner*—Lincoln Donovan
*Assistant Examiner*—Bernard Rojas
(74) *Attorney, Agent, or Firm*—Hovey Williams LLP

(57) ABSTRACT

A magnetic switch (10) for detecting relative movement between first and second members (12, 14) is provided which includes a switch assembly (20, 50, 70) for mounting in one of the members (12, 14), an attractive component (22, 54, 76) for mounting on the other member; the assembly (20, 50, 70) preferably includes plural switch elements (40, 26, 70, 56, 92, 80) and a conductive, shiftable body (44), whereas the component (22, 54, 76) is magnetically attractive to the body (44). The first switch elements (40, 70, 92) are preferably formed of a magnetically attractive material while the body (44) is fabricated from permanently magnetized material, so that the body (44) remains permanently magnetically coupled with the element(s) (40, 70, 92) in all positions of the body (44). Alternately, the switch assemblies (20, 50, 70) can be used as proximity detectors so as to generate a signal in the presence of an adjacent ferrometallic or permanently magnetized object (108).

37 Claims, 2 Drawing Sheets

MAGNETIC SWITCH ASSEMBLY

BACKGROUND OF THE INVENTION

1. Field of the Invention

The present invention is broadly concerned with magnetic switch devices operable to detect relative movement between first and second members, and as proximity detectors. The switches include a switch assembly for mounting to a first member and an attractive component being either itself the component to be detected or for mounting to the second member. The switch assembly preferably includes first and second spaced switch elements and an electrically conductive body shiftable between a first position in simultaneous contact with the first and second switch elements and a second position out of such simultaneous contact. The first switch element is formed of a magnetically attractive material, while the shiftable body is preferably permanently magnetized. When the first and second members are located so that the attractive component is proximal to the switch assembly, the shiftable body is moved to one of its position by virtue of the magnetic attraction between the body and the attractive component. However, when the members are positioned so that the attractive component is remote from the switch assembly, the body is moved to the other of its positions because of the magnetic attraction between the body and the first switch element. Hence, the body remains in contact with the first switch element when the body is in either of its positions, because of the magnetic attraction between the body and the first switch element. In other embodiments, a magnetic switch may be provided having three or four switch elements.

2. Description of the Prior Art

Prior art security alarm systems often make use of magnetic switches attached to doors and windows and integrated with the system for detecting unauthorized openings. One common type of magnetic switch used in these situations is a so-called reed switch. It has been found that reed switches are subject to unauthorized manipulation through use of an external magnet. Specifically, an intruder can hold a relatively strong magnet adjacent the reed switch which will then be operated (to either, open or close depending on the control scheme). With this accomplished, an intruder can open the door or window without triggering the alarm system.

A number of magnetic switches have been proposed in the past to overcome the inherent deficiencies of reed switches. U.S. Pat. Nos. 5,997,873, 5,530,428, 5,332,992, 5,673,021, 5,880,659, 6,506,987 and 6,603,378 describe switches of this type. These switches typically include a pair of spaced apart switch elements with a shiftable body (e.g., a spherical ball) movable between a first position where the ball is in simultaneous contact with both elements and a second position out of such simultaneous contact. An alarm circuit is operatively coupled with the switch elements so as to detect movement of the body. These switches represent a very significant advance in the art.

SUMMARY OF THE INVENTION

The present invention is directed to improved magnetic switches of the type described above, but are less costly to produce and maintain. Broadly speaking, a magnetic switch in accordance with the invention for detecting relative movement between first and second members (e.g, a door and door frame or a window and window frame). In one embodiment, the switch comprises a switch assembly for mounting to the first member, including a first switch element, a second switch element in spaced relationship to the first element, and an electrically conductive, shiftable body. The body is shiftable between a first position where the body is in simultaneous contact with the first and second switch elements, and a second position where the body is out of the simultaneous contact with the first and second switch elements. The overall switch further includes an attractive component for mounting to the second member. The first switch element is formed of electrically conductive material which magnetically attracts the shiftable body. Correspondingly, the shiftable body is formed of electrically conductive, permanently magnetized material which is magnetically attracted to the first switch element and to the attractive component. The first switch element, attractive component and body are selected and located so that, when the first and second members are in an initial relative orientation where the attractive component is proximal to the switch assembly, the body will be shifted to one of the first and second positions thereof by virtue of a magnetic attraction between said body and the attractive component, and so that, when the first and second members are in a different relative orientation wherein the attractive component is remote from the switch assembly, the body is shifted to the other of the first and second positions thereof by virtue of a magnetic attraction between the body and the first switch element. Thus, the shiftable body remains in contact with the first switch element when the body is in either of the first of second positions thereof, by virtue of the magnetic attraction between the body and the first switch element.

In preferred forms, the switch assembly is made up of a closed, magnetic or non-magnetic metallic housing having a non-conductive cover so that the housing forms the first switch element; the second switch element includes an elongated, rod-like component which may be formed of high magnetic permeability nickel alloy having a relative magnetic permeability of at least 600; alternately, the component may be formed of iron, cobalt or an alloy of nickel, iron and cobalt. The attractive component may be formed of partially annealed steel or it may be formed of permanently magnetized material.

In other embodiments, a magnetic switch is provided including a switch assembly for mounting to the first member, including a housing formed of magnetic or non-magnetic electrically conductive material and presenting a chamber with a circumscribing sidewall and a bottom wall, and a top cover having a portion thereof formed of non-electrically conductive material. The housing defines a second switch element, and the assembly also has a plurality (usually 2 or 3) spaced apart switch elements each in the form of an elongated, rod-like component and extending through the non-conductive portion of the top cover into the chamber. A shiftable body is within the chamber and is formed of an electrically conductive permanently magnetized material. An attractive component for coupling to said second member also forms a part of the magnetic switch. The plural switch elements, the attractive component and the body are selected and located so that, when the first and second members are in the first adjacent position, the body will be in simultaneous contact with at least one of the plural elements and the second switch element by virtue of a magnetic attraction between said body and the attractive component; moreover, when the first and second members are in the second separated position, the body will be in simultaneous contact with one or more of the plural switch elements by virtue of a magnetic attraction between the body and the associated rod-like switch elements.

The switch assemblies of the invention may also be used as proximity detectors, particularly for detecting the presence of nearby ferrometallic objects. In such a utility, a switch assembly of the type described above is located in an area for proximity detection. When a ferromagnetic object is not present, the body of the switch assembly is in one position thereof. However, when a ferrometallic object is positioned close to the switch assembly, the magnetic attraction between the shiftable body of the switch assembly and the object causes the body to move to a different switch position. The switch assembly then generates a signal indicative of the proximity of the ferrometallic object.

DETAILED DESCRIPTION OF THE PREFERRED EMBODIMENT

Figure 1:
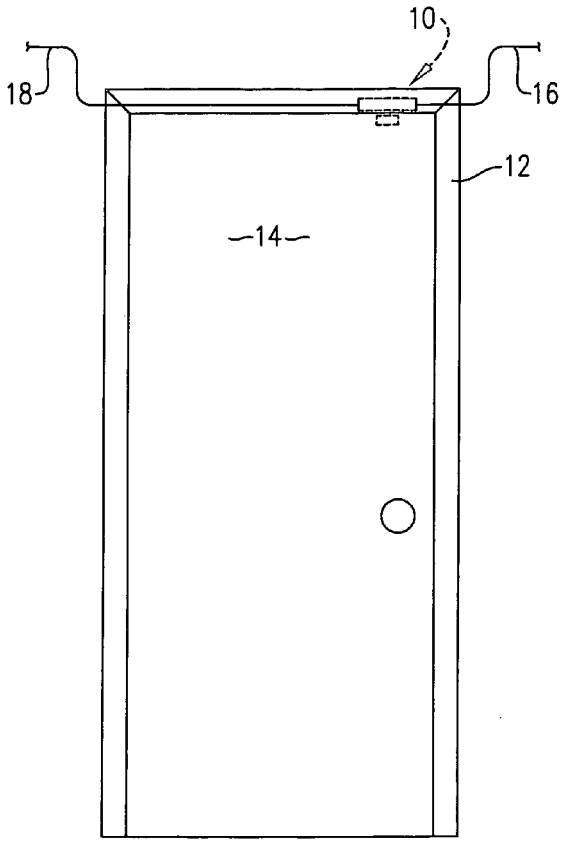
FIG. 1 illustrates a preferred magnetic switch in accordance with the invention, depicted in use for protecting a door.
Figure 3:
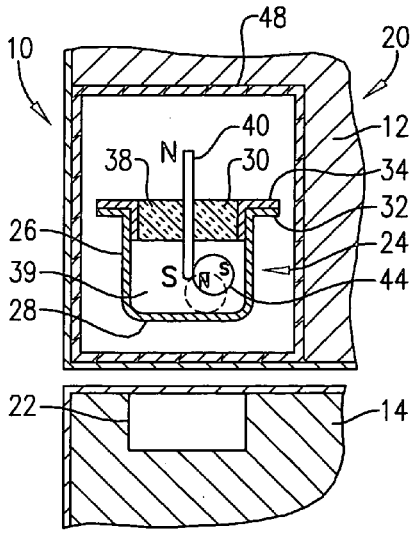
FIG. 3 is a vertical sectional view depicting the construction and operation of the preferred magnetic switch when the door is closed.
Figure 2:
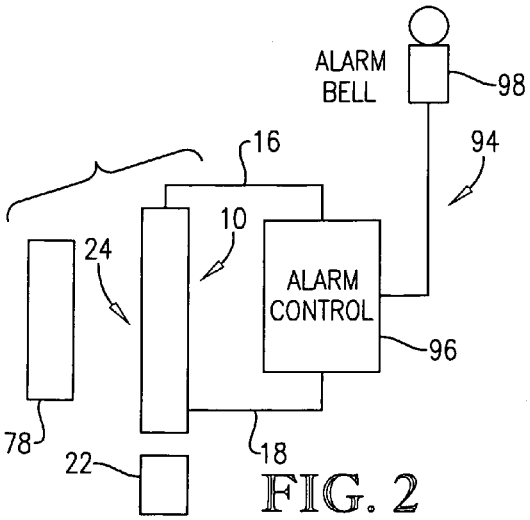
FIG. 2 is a schematic depiction of a preferred alarm system using the preferred magnetic switch device of the invention.

Embodiment of FIGS. 1–3

Turning now to the drawing, FIG. 1 illustrates a magnetic switch 10 (dashed lines) shown in use with a door frame 12 and door 14. Appropriate electrical leads 16, 18 are operatively coupled with the switch 10 as will be described below in more detail.

The switch 10 (FIG. 3) includes a switch assembly 20 designed to be secured to frame 12, as well as an attractive component 22 which is mounted to door 14. The switch assembly 20 in preferred forms includes a housing 24 having a circumscribing annular converging sidewall 26, an integral bottom wall 28 and a top cover 30. Preferably, the housing 24 presents a circumscribing flange 32 and is formed of a suitable electrically conductive stainless steel such as 304; however, it could also be formed of non-magnetic conductive materials such as copper. The top cover 30 includes an outboard flange 34 adapted to mate with flange 32, and a central glass or ceramic nonconductive plug 38. The flange 34 is preferably formed of stainless steel, but alternately may be of copper or the like. The top cover 30 is welded to sidewall 26 at the facing contact between the flanges 32 and 34, thereby creating a hermetically sealed internal chamber 39. It is preferred that the chamber 39 be filled with an inert gas such as argon.

The assembly 20 also includes an elongated, depending, substantially upright first switch element 40 which as shown is elongated and rod-like and extends downwardly through plug 38 to a point spaced above bottom wall 28, so that the housing 26 serves as the second switch element for the assembly.

A shiftable body 44 is located within housing 24 and is formed of electrically conductive material which is also permanently magnetized. Preferred configurations of body 44 include arcuate objects such as substantially spherical balls or cylinders.

As illustrated, the housing 24 may be located within housing box 48 positioned within an appropriately sized recess in frame 12. However, such a mounting arrangement is not essential.

The attractive component 22 is mounted to door 14, preferably along a horizontal vertical edge thereof near the top of the door. When the door 14 is closed relative to frame 12, it will be seen that the component 22 is directly in juxtaposition to housing 24. Obviously, when the door 14 is opened, the component 22 is spaced from the housing 24.

The first switch element 40 is formed of electrically conductive material which has sufficient relative magnetic permeability ($\mu r$) such that the element 40 is attractive to body 44. Thus, the element 40 may be fabricated from any permanently magnetized material or from an appropriate nickel, iron or cobalt alloy having the requisite relative magnetic permeability. Such relative magnetic permeability should be at least about 600, more preferably at least about 5,000, and most preferably about 10,000.

The attractive body 22 may be formed of a permanently magnetized material or may simply be magnetically attractive (e.g., partially annealed steel) in that it will be attracted by a magnet. In preferred forms, the body 22 is fabricated from a permanently magnetized material.

The first switch element 40, housing 24, attractive component 22 and body 44 are selected and located in the switch 10 so that when the door 14 and frame 12 are in an initial closed orientation where the attractive component 22 is proximal to the switch assembly 20, the body 44 will be shifted to the dotted line position illustrated in FIG. 3, i.e., the body 44 is in simultaneous contact with the first and second switch elements 40, 28. This occurs by virtue of the magnetic attraction between the body 44 and the wall 28 and/or the adjacent attractive component 22. Furthermore, these parts are designed so that, when the door 14 is opened and the attractive component 22 is remote from the switch assembly 20, the body 44 is shifted to the full line position depicted in FIG. 3, namely where the body 44 is suspended because of the magnetic attraction between the latter and first switch element 40. Although not essential, the switch 10 would normally be designed so that the switch would be "closed" in the dotted line position of body 44, and would be "open" in the full line position thereof.

It will be understood that the body 44 presents a N-S polar axis, and that the element 40 also has a N and S end. Accordingly, one end of the body's polar axis (shown as "N" in FIG. 3) is attracted to the opposite polar end of the element 40, and is effectively permanently magnetically attached to the element 40. Hence, during operation of the assembly 20, the body 44 moves between the two FIG. 3 positions while remaining always magnetically adhered to the element 40.

FIG. 2 illustrates a conventional hookup of switch 10 within an alarm circuit 94. In particular, the housing 24 is electrically coupled with a conventional alarm control 96, that is lead 16 is operatively coupled with first switch element 40 and lead 18 is coupled with the second switch element 26, with both leads connected to control 96. The alarm circuit 94 in the illustrated embodiment is configured so that when door 14 is closed, the body 44 is in the closed position in simultaneous contact with the elements 40, 26 and no alarm signal is generated. However, when the door 14 is opened and the body 44 is shifted to the open position out of such simultaneous contact, an alarm signal is generated. An alarm bell 98 or similar output device is typically connected with control 72. Switch assemblies 50 and 72 would be similarly connected into the circuit 94, but of course this would entail connection of multiple leads into the circuit, corresponding to elements 40, 70 and 92.

It will thus be appreciated that if an intruder uses an external magnet in an attempt to defeat switch 10 while door 14 is closed, the body 44 is moved because of the magnetic attraction between such external magnet to the open position. Specifically, a magnet placed adjacent frame 12 in proximity to switch assembly 20 when door 14 is closed will have the effect of shifting body 44 to the FIG. 3 dotted line position out of simultaneous contact with switch elements 40, 26. Consequently, any such attempt to defeat the switch 10 will immediately set off the alarm. Similarly use of an external magnet in an effort to defeat assemblies 50 or 72 would cause alarm-generating movement of body 44.

Figure 4:
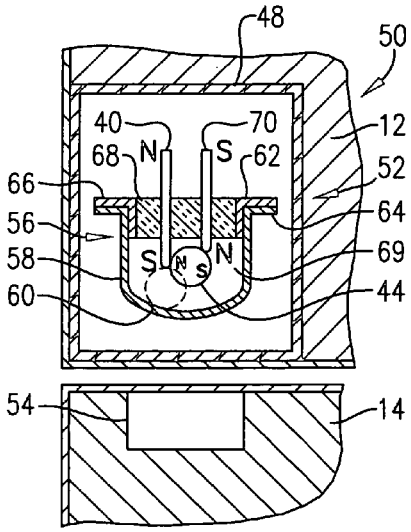
FIG. 4 is a vertical sectional view similar to that of FIG. 3, but illustrating another switch embodiment in accordance with the invention.
Figure 7:
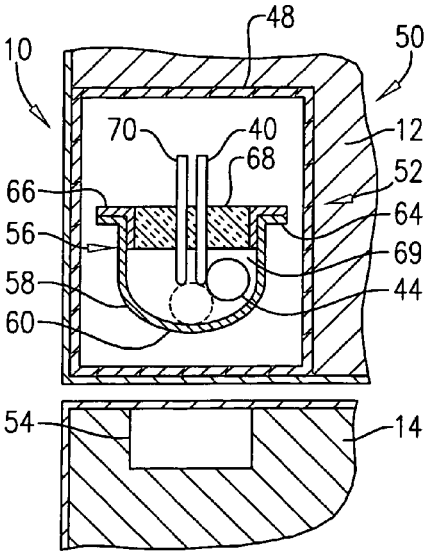
FIG. 7 is a vertical sectional view of a still further switch assembly embodiment in accordance with the invention.

Embodiments of FIGS. 4 and 7

FIGS. 4 and 7 illustrate another embodiment in accordance with the invention which is similar to the FIG. 3 embodiment, and thus certain components have been identically numbered. The switch 50 includes a switch assembly 52 adapted for mounting within a housing 48 of door frame 12, together with an attractive component 54 mounted in door 14. The component 54 is identical to component 22 previously described.

The assembly 52 includes a housing 56 having a circumscribing annular sidewall 58, an integral, concavo-convex bottom wall 60 and a top cover 62. Preferably, the housing 56 presents a circumscribing flange 64 and is formed of a suitable electrically conductive magnetic or non-magnetic stainless steel such as 304 or copper. The top cover 62 includes an outboard flange 66 adapted to mate with flange 64, and a central glass or ceramic nonconductive plug 68. The flange 66 is preferably formed of stainless steel or copper and is welded to flange 64. This forms an internal chamber 69 which is usually filled with inert gas, e.g., argon.

The assembly 52 also includes a pair of elongated, depending, substantially upright first and third switch elements 40, 70 which as shown are each elongated and rod-like. The elements 40, 70 extend downwardly through plug 68 into chamber 69 to a point spaced above bottom wall 60, the latter serving as the second switch element for the assembly. It will also be seen that the switch elements 40, 70 are laterally spaced apart and that the element 70 is somewhat shorter in length as compared with element 40 (FIG. 4); however, the elements 40, 70 may be of the same length as FIG. 7. The element 40 serves as the "common" for the switch. The overall switch assembly 50 also includes a shiftable, electrically conductive, permanently magnetized body 44 within the housing 56.

The first and third switch elements 40, 70 can each be formed of electrically conductive material which has a high magnetic permeability, as described with reference to element 40 in the FIG. 3 embodiment. However, in principle only one of these elements need be formed of such material. Thus, the other of the switch elements may be formed of a magnetically attractive material such as steel.

The materials used in fabricating the attractive component 54, switch elements 40, 70, housing 58 and the body 44 can be varied, so long as the operational principles of the switch 10 are maintained. For example, and in preferred forms, the body 44 may be formed of the previously described permanently magnetized material. In such an instance, the attractive component 54 may be formed of steel (e.g., partially annealed steel) or of complementary magnetized material relative to the body 44. Alternately, the component 54 may be formed of permanently magnetized material while the body 44 is formed of any material which is magnetically attracted to the first and second components. As explained, the goal in selecting the materials for the components parts of the switch 50 is to assure that the body 44 may be appropriately magnetically shifted when the door 14 is moved between the closed and open positions thereof.

Specifically, and referring to FIGS. 4 and 7, it will be seen that, when the door 14 is closed relative to frame 12, the body 44 is shifted downwardly or laterally by virtue of a magnetic attraction between the attractive component 54 and the body 44, so as to hold the body 44 in the FIG. 4 dotted line position in simultaneous contact with the switch elements 40 and/or 70 and the housing 58. In this orientation, the magnetic attraction between component 54 and body 44 is greater than and overcomes the magnetic attraction between body 44 and the elements 40 and 70.

When the door 14 is open so that attractive component 54 is remote from the switch assembly 20, the body 44 is magnetically shifted to the full line position thereof, i.e., in contact with the switch elements 40 and/or 70 and out of contact with housing 58. This shifting is effected because of the magnetic attraction between the body 44 and switch elements 40 and 70.

As in the case of the switch assembly 20, the magnetic polarities between the body 44 and switch elements 40, 70 assures that the body 44 is permanently magnetically coupled with the element 40. Thus, it moves between the FIG. 4 positions while continuously magnetically adhered to the element 40 and/or 70.

Figure 5:
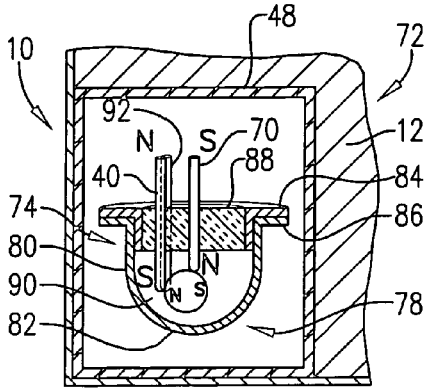
FIG. 5 is a vertical sectional view depicting the construction of another embodiment having four switch elements, with the switch assembly in one operative position.
Figure 6:
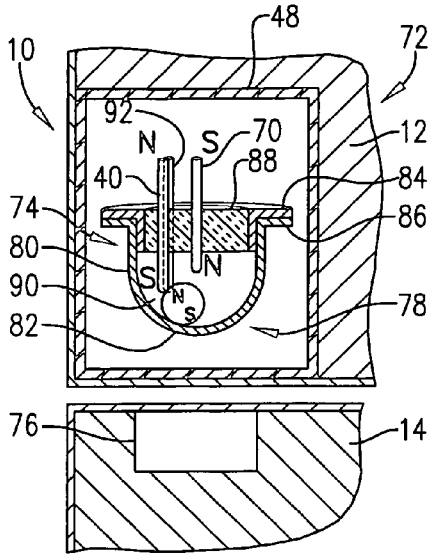
FIG. 6 is a view similar to that of FIG. 5, but showing the assembly in another operative position.

Embodiments of FIGS. 5 and 6

FIGS. 5 and 6 illustrate another embodiment in accordance with the invention which is similar to the FIG. 3 embodiment, and thus certain components have been identically numbered. The switch 72 includes a switch assembly 74 adapted for mounting within a housing 48 of door frame 12, together with an attractive component 76 mounted in door 14. The component 76 is identical to component 22 previously described.

The assembly 74 includes a housing 78 having a circumscribing annular sidewall 80, an integral, concavo-convex bottom wall 82 and a top cover 84. Preferably, the housing 78 presents a circumscribing flange 86 and is formed of a suitable electrically conductive magnetic or non-magnetic stainless steel such as 304 or copper. The top cover 84 includes an outboard flange adapted to mate with flange 64, and a central glass or ceramic nonconductive plug 88. The cover flange is preferably formed of stainless steel or copper and is welded to flange 86. This forms an internal chamber 90 which is usually filled with inert gas, e.g., argon.

The assembly 74 also includes three elongated, depending, substantially upright first, third and fourth switch elements 40, 70 and 92 which as shown are each elongated and rod-like. The elements 40, 70 and 92 extend downwardly through plug 88 into chamber 90 to a point spaced above bottom wall 82, the latter serving as the second switch element for the assembly. It will also be seen that the switch elements 40, 70 and 92 are laterally spaced apart and that the elements 70 and 92 are somewhat shorter in length as compared with element 40; however, elements 40, 70 and 92 may be of the same length. The element 40 serves as the "common" for the switch. The overall switch assembly 74 also includes a shiftable, electrically conductive, permanently magnetized body 44 within the housing 78.

The switch elements 40, 70 and 92 can each be formed of electrically conductive material which has a high magnetic permeability, as described with reference to element 40 in the FIG. 3 embodiment. However, in principle only one of these elements need be formed of such material. Thus, the other of the switch elements may be formed of a magnetically attractive material such as steel.

The materials used in fabricating the attractive component 76, switch elements 40, 70 and 92, housing 78 and the body 44 can be varied, so long as the operational principles of the switch 10 are maintained. As noted above, the body 44 may be formed of a permanently magnetized material, such as those previously disclosed. The attractive component 76 may be formed of steel (e.g., partially annealed steel) or of complementary magnetized material relative to the body 44. Alternately, the components 76 may be formed of permanently magnetized material while the body 44 is formed of any material which is magnetically attracted thereto. As earlier explained, the goal in selecting the materials for the component parts of the switch 72 is to assure that the body 44 may be appropriately magnetically shifted when the door 14 is moved between the closed and open positions thereof.

Specifically, it will be seen that when the door 14 is closed relative to frame 12, the body 44 is shifted downwardly or laterally by virtue of a magnetic attraction between the second attractive component 76 and the body 44, so as to hold the body 44 in the FIG. 6 position in simultaneous contact with the switch elements 40, 92 and the housing 58. Of course, in this orientation, the magnetic attraction between component 76 and body 44 is greater than and overcomes the magnetic attraction between body 44 and the elements 40, 70 and 92.

When the door 14 is open so that attractive component 76 is remote from the switch assembly 74, the body 44 is magnetically shifted to the FIG. 5 position in simultaneous contact with elements 40, 70 and 92, and out of contact with housing 78. As will be readily understood, this shifting is effected because of the magnetic attraction between the body 44 and switch elements 40, 70 and 92.

The magnetic polarities between the body 44 and switch elements 40, 70 and 92 assures that the body 44 is permanently magnetically coupled with the elements 40 and 92. Thus, it moves between the FIGS. 5 and 6 positions while continuously magnetically adhered to the elements 40, 92.

Figure 8:
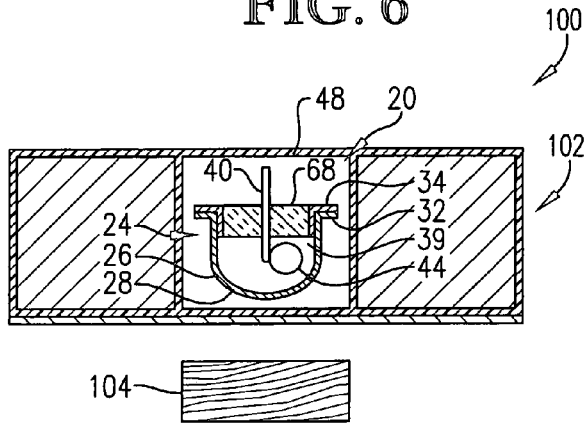
FIG. 8 is a schematic representation of a switch assembly of the present invention used as proximity detector, with the switch assembly in an initial position where no detectable object is present.
Figure 9:
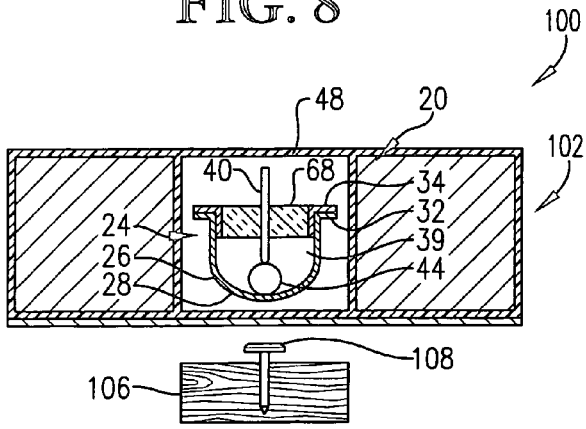
FIG. 9 is a schematic representation similar to that of FIG. 8, but showing the switch assembly in is detection position upon detection of an adjacent ferrometallic object.

Embodiments of FIGS. 8–9

FIGS. 8–9 illustrate the use of a switch assembly in accordance with the invention as a proximity detector. Thus, a proximity detector 100 is provided including a mount 102 having a switch assembly 20 (see FIGS. 1–3) therein. The components of assembly 20 are identical to those previously described, and thus the same reference numerals have been applied. However, it will be noted that in this context, no separate attractive component 22 is used. Instead, the switch assembly 20 detects the presence of a ferromagnetic object adjacent detector 100.

Attention is first directed to FIG. 8 which illustrates the detector 20 with a piece of wood 104 proximal to switch assembly 20. In such a condition, it will be observed that the magnetic attraction between element 40 and body 44 causes the latter to remain in contact with the element and out of contact with housing 26. However, when another wooden piece 106 having nail 108 therein is adjacent detector 100, the magnetic attraction between the body 44 and nail 108 causes the body 44 to shift downwardly into a position where it is in simultaneous contact with element 40 and portion 28 of housing 26. In this orientation, an appropriate signal will be generated through the associated proximity alarm circuitry to signal the proximity of the ferrometallic object.

While the FIGS. 8–9 illustration depicts a situation where the body 44 is moved from the second position thereof out of simultaneous contact with the switch elements 40, 28, to the first position in such simultaneous contact, those skilled in the art will understand that the situation could be reversed, i.e., the switch assembly 20 could be oriented so that, when the object 108 is detected, the element 44 would move from the simultaneous contact first position to the second position out of simultaneous contact. It will also be appreciated that any of the other switch assembly embodiments shown in FIGS. 4–7 could be used in the proximity detector context, in lieu of switch assembly 20. Moreover, it will be understood that switch assemblies of the invention could be used for the detection of any significant ferromagnetic or permanently magnetized object, and that the FIG. 9 illustration of a nail 108 is exemplary only.

While the disclosed embodiments have been illustrated in connection with door 14 and frame 12, it will be appreciated that the invention is broadly applicable for detecting movement between first and second members, including doors, windows and gates. Also, the switch assemblies can be used as proximity detectors as discussed with reference to FIGS. 8 and 9.

I claim:

1. A magnetic switch for detecting relative movement between first and second members, said switch comprising:

a switch assembly for mounting to the first member, including a first switch element, a second switch element in spaced relationship to the first element, and an electrically conductive, shiftable body, said body shiftable between a first position where the body is in simultaneous contact with said first and second switch elements, and a second position where the body is out of said simultaneous contact with the first and second switch elements; and an attractive component for mounting to said second member, said first switch element formed of electrically conductive material which magnetically attracts said body, said body formed of electrically conductive, permanently magnetized material which is magnetically attracted to said first switch element and to said attractive component, said first switch element, attractive component and body being selected and located so that, when the first and second members are in an initial relative orientation where said attractive component is proximal to said switch assembly, said body will be shifted to one of the first and second positions thereof by virtue of a magnetic attraction between said body and said attractive component, and so that, when the first and second members are in a different relative orientation wherein said attractive component is remote from the switch assembly, said body is shifted to the other of said first and second positions thereof by virtue of a magnetic attraction between the body and said first switch element, said body remaining in contact with said first switch element when the body is in either of the first or second positions thereof, by virtue of the magnetic attraction between said body and said first switch element.

2. The switch of claim 1, said attractive component formed of steel or partially annealed steel.

3. The switch of claim 1, said attractive component formed of permanently magnetized material.

4. The switch of claim 1, said switch assembly including a closed housing having said first element disposed therein.

5. The switch of claim 4, said housing including a cover having a portion thereof formed of non-conductive material.

6. The switch of claim 1, said first switch element comprising an elongated, rod-like component.

7. The switch of claim 6, said rod-like component formed of high magnetic permeability nickel alloy.

8. The switch of claim 1, said second switch component comprising a wall in spaced relationship to said first element and formed of electrically conductive material.

9. The switch of claim 1, including a third switch element spaced from said first and second switch element and formed of electrically conductive material which will be magnetically attracted to said body, said first, second and third switch elements, said attractive component and said body being selected and located so that, when said first and second members are in said initial orientation, said body will be in simultaneous contact with said first and second switch elements or said third and second switch elements by virtue of a magnetic attraction between said body and said attractive components, and such that when said first and second members are in said different orientation said body will be in simultaneous contact with said first and third switch elements by virtue of a magnetic attraction between said body and the first and third switch elements.

10. The switch of claim 9, said third switch element formed of steel or partially annealed steel.

11. The switch of claim 10, including a fourth switch element spaced from said first and third switch elements.

12. The switch of claim 11, said third and fourth switch element each comprising an elongated rod-like component.

13. A magnetic switch for detecting relative movement between first and second members when the members are moved from a first, substantially adjacent position to a second position where the members are separated, said switch comprising:

a switch assembly for mounting to said first member, including a housing formed of electrically conductive material and presenting a chamber with a circumscribing sidewall and a bottom wall, and a top cover, said top cover having a component thereof formed of non-electrically conductive material, said housing defining a second switch element, a plurality of spaced apart switch elements each in the form of an elongated, rod-like component and extending through said top cover component into said chamber, and a shiftable body within the chamber formed of an electrically conductive permanently, magnetized material; and an attractive component for coupling to said second member, said plurality of switch elements, said attractive component and said body being selected and located so that, when said first and second members are in said first adjacent position, said body will be in simultaneous contact with at least one of said plurality of switch elements and said second switch elements by virtue of a magnetic attraction between said body and said attractive components, and such that when said first and second members are in said second separated position, said body will be in simultaneous contact with at least one of said plurality of switch elements by virtue of a magnetic attraction between said body and said at least one of said plurality of switch elements.

14. The switch of claim 13, said plurality of switch elements each formed of steel or partially annealed steel.

15. The switch of claim 13, said attractive component formed of permanently magnetized material.

16. The switch of claim 13, said attractive component formed of steel or partially annealed steel.

17. The switch of claim 13, said body formed of a material selected from the group consisting of samarium-cobalt alloy and neodynium iron boron.

18. The switch of claim 17, said body being the form of a spherical ball.

19. A magnetic switch assembly comprising:

a first switch element, a second switch element in spaced relationship to the first element, and an electrically conductive, shiftable body, said body shiftable between a first position where the body is in simultaneous contact with said first and second switch elements, and a second position where the body is out of said simultaneous contact with the first and second switch elements; and said first switch element formed of electrically conductive material which magnetically attracts said body, said body formed of electrically conductive, permanently magnetized material which is magnetically attracted to said first switch element, said body remaining in contact with said first switch element when the body is in either of the first or second positions thereof, by virtue of the magnetic attraction between said body and said first switch element.

20. The switch assembly of claim 19, said switch assembly including a closed housing having said first element disposed therein.

21. The switch assembly of claim 20, said housing including a cover having a portion thereof formed of non-conductive material.

22. The switch assembly of claim 19, said first switch element comprising an elongated, rod-like component.

23. The switch assembly of claim 22, said rod-like component formed of high magnetic permeability nickel alloy.

24. The switch assembly of claim 19, said second switch component comprising a wall in spaced relationship to said first element and formed of electrically conductive material.

25. The switch assembly of claim 19, including a third switch element spaced from said first and second switch element and formed of electrically conductive material which will be magnetically attracted to said body, said body in said first position thereof being in contact with at least one of said first and third switch elements, and said body in said second position thereof being in contact with at least one of said first and third switch elements and said second switch element.

26. The switch assembly of claim 25, said third switch element formed of steel or partially annealed steel.

27. The switch assembly of claim 19, including a fourth switch element spaced from said first and second switch elements.

28. The switch assembly of claim 27, said third and fourth switch element each comprising an elongated rod-like component.

29. A proximity detector for detecting the proximity of an adjacent ferromagnetic or magnetized object, comprising:

a switch assembly including a first switch element, a second switch element in spaced relationship to the first element, and an electrically conductive, shiftable body, said body shiftable between a first position where the body is in simultaneous contact with said first and second switch elements, and a second position where the body is out of said simultaneous contact with the first and second switch elements; and said first switch element formed of electrically conductive material which magnetically attracts said body, said body formed of electrically conductive, permanently magnetized material which is magnetically attracted to said first switch element, said body remaining in contact with said first switch element when the body is in either of the first or second positions thereof, by virtue of the magnetic attraction between said body and said first switch element, said body shiftable from the first or second position thereof to the second or first position thereof when said object is proximal to the switch assembly.

30. The proximity detector of claim 29, said body shiftable from said first position to said second position when said object is proximal to the switch assembly.

31. The proximity detector of claim 29, said switch assembly including a closed housing having said first element disposed therein.

32. The proximity detector of claim 31, said housing including a cover having a portion thereof formed of non-conductive material.

33. The proximity detector of claim 29, said switch element comprising an elongated rod-like component.

34. The proximity detector of claim 33, said rod-like component formed of high magnetic permeability nickel alloy.

35. The proximity detector of claim 29, said second switch component comprising a wall in spaced relationship to said first element and formed of electrically conductive material.

36. A method of detecting the proximity of a ferrometallic or magnetized object, said method comprising the steps of:

providing a switch assembly including a first switch element, a second switch element in spaced relationship to the first element, and an electrically conductive, shiftable body, said body shiftable between a first position where the body is in simultaneous contact with said first and second switch elements, and a second position where the body is out of said simultaneous contact with the first and second switch elements; and said first switch element formed of electrically conductive material which magnetically attracts said body, said body formed of electrically conductive, permanently magnetized material which is magnetically attracted to said first switch element, said body remaining in contact with said first switch element when the body is in either of the first or second positions thereof, by virtue of the magnetic attraction between said body and said first switch element; and shifting said body from the first or second position thereof to the second or first position thereof when said object is proximal to the switch assembly.

37. The method of claim 36, including the step of switching the body from the second position thereof to said first position thereof when said object is proximal to the switch assembly.

* * * * *